US005153547A

United States Patent [19]

Mamiya

[11] Patent Number: 5,153,547

[45] Date of Patent: Oct. 6, 1992

[54] HIGH FREQUENCY COIL

[75] Inventor: Yasunori Mamiya, Tsurugashima, Japan

[73] Assignee: Toko Kabushiki Kaisha, Tokyo, Japan

[21] Appl. No.: 715,589

[22] Filed: Jun. 14, 1991

[30] Foreign Application Priority Data

Jun. 20, 1990 [JP] Japan ..... 2-65098[U]

[51] Int. Cl.[5] ..... H01F 15/02; H01F 27/26

[52] U.S. Cl. ..... 336/83; 336/92; 336/136

[58] Field of Search ..... 336/136, 83, 90, 92, 336/233, 234, 198

[56] References Cited

U.S. PATENT DOCUMENTS 2,905,913 9/1959 Leigh ..... 336/83

3,358,255 12/1967 Digilio ..... 336/83

*Primary Examiner*—Thomas J. Kozma

*Attorney, Agent, or Firm*—Stevens, Davis, Miller & Mosher

[57] ABSTRACT

A bobbin provides a coil wound on the outer peripheral surface and allows a threaded core to be screwed on the inner peripheral surface. This bobbin is covered with a jar-like core and a metal case. The jar-like core and the metal case provide through holes for receiving a driver used to handle a threaded core. The edge of the through hole of the metal case is located radially inside or outside of the edge of the through hole of the jar-like case. It results in preventing the edge of the through hole of the jar-like core from being broken by a burr formed on the edge of the through hole of the metal case.

6 Claims, 1 Drawing Sheet

HIGH FREQUENCY COIL

BACKGROUND OF THE INVENTION

1. Field of the Invention

The present invention relates to a high frequency coil which is constructed to provide a shield case and a jar-like core both having through holes for adjusting inductance and is designed to prevent a core from being broken by a burr left on the edge of the hole of the through case.

2. Description of the Prior Art

A conventional high frequency coil is normally constructed to cover a bobbin having a coil wound thereon with a jar-like, core and a metal case with the threaded core being screwed into the bobbin. Such a high frequency coil provides through holes in the case and the jar-like core to provide access for a driver used to vertically move the threaded core.

It is better to make those holes as small as possible from the standpoint of a magnetic shield effect and a closed magnetic path effect.

To keep the quality against a magnetic flux focused on the edge of the hole of the case, the conventional high frequency coil provides a larger hole in the case than in the jar-like core.

However, the smaller coil results in disadvantageously breaking the jar-like core.

The present inventors studied and found the cause of this problem.

That is, as shown in FIG. 6, which is a sectional view showing holes of the metal case 40 and the jar-like core 43, a burr 42 whose length is about 0.1 to 0.2 mm is likely to be formed on the edge of a hole 41 of the case 40 when hole 41 is formed by means of press working.

As the overall dimension of the high frequency coil designed for surface mounting on a printed circuit board becomes smaller and smaller, the dimension of the jar-like core, one of the components of the coil, is made smaller. In particular, the thickness of the jar-like core is as thin as about 0.5 mm.

The jar-like core 43 is automatically pressurized and fitted into the case 40 by means of the machine. In this operation, the burr 42 formed on the edge 45 of the hole 44 of the core 43 may often break or crack a part of the edge 45, resulting in breaking the core 43.

It is possible to take the working step of removing the burr 42 from the case 40. However, this step contributes to increasing the cost of the case so that completed coil becomes too expensive to sell.

SUMMARY OF THE INVENTION

It is an object of the present invention to provide a high frequency coil which is capable of preventing a jar-like coil from being broken by a burr formed on the edge of a hole of a case.

In carrying out the object in a preferred mode, the present invention provides a high frequency coil which includes a bobbin having a winding portion to be screwed with a threaded core, a coil wound on the bobbin, a jar-like core covered on the bobbin, a metal case covered on the jar-like core, and holes formed on the jar-like core and the metal case, the holes being formed to receive a driver for vertically moving the threaded core as being rotated, the edge of the hole of the jar-like core coming into contact with the hole plane of the case being located outside of the edge of the hole of the case on the plane level.

DESCRIPTION OF THE PREFERRED EMBODIMENTS

Figure 1:
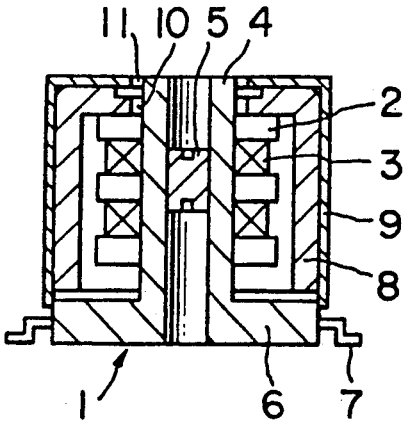
FIG. 1 is a sectional view showing a high frequency coil according to a first embodiment of the present invention.
Figure 2:
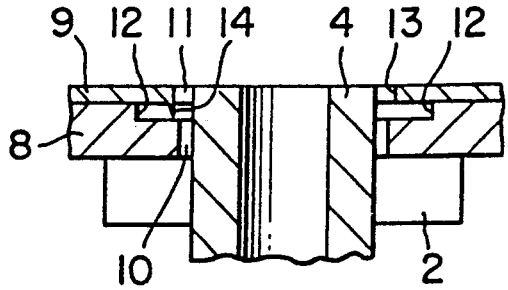
FIG. 2 is a partially enlarged sectional view showing a part of the high frequency coil shown in FIG. 1.
Figure 3:
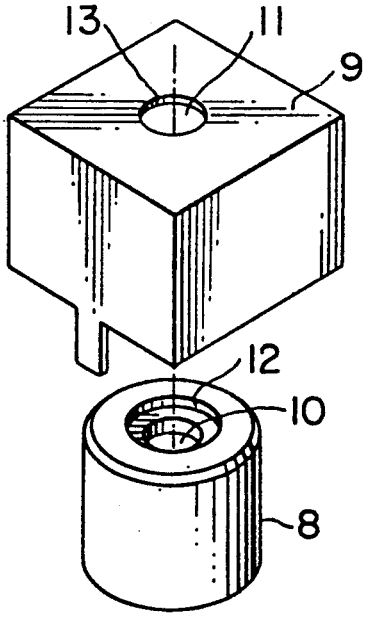
FIG. 3 is a perspective view showing a case and a core included in the high frequency coil.

The description will be directed to the high frequency coil according to a first embodiment of the invention with reference to FIGS. 1 to 3, in which FIG. 1 is a sectional view of the coil, FIG. 2 is a partially enlarged sectional view showing holes of a metal case and a jar-like core, and FIG. 3 is a perspective view showing the metal case and the jar-like core.

1 denotes a bobbin made of synthetic resin and having collars 2. The bobbin 1 provides a coil 3 between the adjacent collars 2. The bobbin 1 further includes a hollow winding portion 4 to which a threaded core 5 is screwed for adjusting inductance and a base 6, the side surface of which has a terminal 7 designed for surface mounting.

8 denotes a jar-like core which covers the coil-wound portion of the bobbin 1. 9 denotes a metal case which is inserted into the base 6 in a manner to cover the jar-like core 8.

The core 8 and the case 9 provides concentric holes 10 and 11 on the tops thereof. The winding portion 4 projected above the collar 2 of the bobbin 1 is fitted into the holes 10 and 11. A driver is fitted into the holes 10 and 11 so as to vertically move the threaded core 5 as being rotated.

Though the inner surface of the case 9 comes in contact with the top of the jar-like core 8, as is obvious from FIG. 2, the section of the hole 10 of the jar-like core 8 is formed in a stepwise manner. The edge portion 12 of the hole 10 of the core 8 is located outside of the edge 13 of the hole 11 of the case 9.

The positional relation between the edge portion 12 of the hole. 10 and the edge 13 of the hole 11 prevents a burr 14 from being in contact with the area around the edge of the hole 10 of the core 8 in case the burr 14 is formed on the edge 13 of the case 9. It results in preventing the core 8 from being broken.

Figure 4:
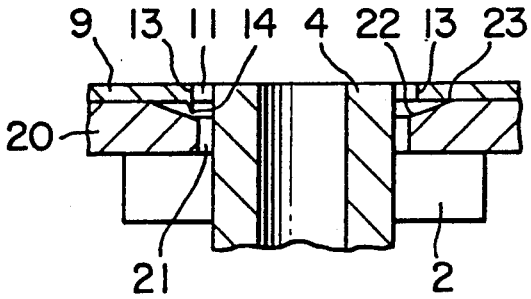
FIG. 4 is a partially enlarged sectional view showing a high frequency coil according to a second embodiment of the present invention.

FIG. 4 is a partially expanded sectional view showing holes of a metal case and a jar-like core included in a high frequency coil according to the second embodiment of the present invention. The same portions as those shown in FIGS. 1 to 3 are referenced by the same numbers.

In this embodiment, a tapered surface 22 is formed on the section of the hole 21 of the jar-like core 20 so that the upper edge portion 23 of the core is located outside of the edge 13 of the hole 11 of the case 9 on the plane level.

Figure 5:
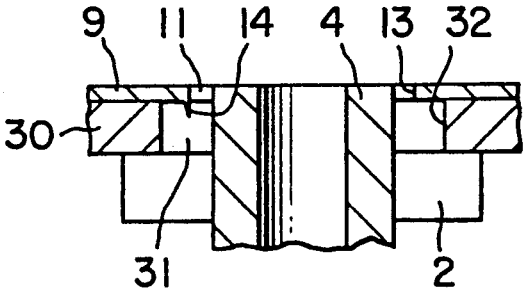
FIG. 5 is a partially enlarged sectional view showing a high frequency coil according to a third embodiment of the present invention.
Figure 6:
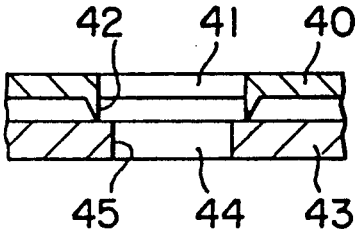
FIG. 6 is a partial sectional view showing the conventional high frequency coil.

FIG. 5 is an expanded sectional view showing holes of the metal case and the jar-like core included in a high frequency core according to the third embodiment of the present invention.

As shown in FIG. 5, the third embodiment is characterized in that the diameter of the hole 31 of the jar-like core 30 is made larger than the diameter of the hole 11 of the case 9 and the overall edge 32 of the hole 31 is slipped a little outside of the edge 13 of the hole 11 of the case 9, resulting in preventing the burr 14 from coming into contact with the area around the edge 32.

The foregoing three embodiments are all constructed to fit the winding portion 4 of the bobbin 1 into the holes of the case and the jar-like core. However, the winding portion 4 may be located under the holes without being fitted to the holes.

The foregoing embodiments have described the high frequency coil designed for surface mounting. However, it goes without saying that the present invention may apply to a high frequency coil having terminal pins for connection.

The threaded core 5 to be screwed with the winding portion 4 may be removed.

As described above, the present invention provides the high frequency coil which is designed to locate the edge portion of the hole of the core being in contact with the case outside of the edge of the hole of the case on the plane level.

In case the hole of the jar-like core is made smaller for reducing leakage of a magnetic flux, the burr formed on the hole edge of the case is not allowed to come into contact with the jar-like core, resulting in preventing the core from being broken. This feature makes a great contribution to enhancing a yield of the high frequency coil in manufacturing process, in particular, the high frequency coil designed for plane connection.

The present invention further makes it possible to use the case formed by the press working, resulting in advantageously reducing the cost of the coil.

If a coil having small inductance is required, the threaded core is removed from the jar like core to minimize the inductance of the coil.

What is claimed is:

1. A high frequency coil comprising;

a bobbin, a coil-wound portion formed on an outside surface of said bobbin, said bobbin including an inside surface comprising a portion to be screwed with a threaded core, a jar-like core covering said bobbin and having a through hole for receiving a driver used to rotate a threaded core, and a metal case covering said jar-like core and having a through hole disposed at a location corresponding to said through hole of said jar-like core, said through hole of said jar-like core having an inner wall surface which includes (a) a first edge portion located radially inside of an edge of said through hole of said metal case and (b) a second edge portion located radially outside said edge of said through hole of said metal case.

2. A high frequency coil according to claim 1, wherein the through hole of said jar-like core and the through hole of said metal case are arranged coaxially around a central axis of said bobbin and located at different axial positions along the central axis.

3. A high frequency coil according to claim 1, wherein the inner wall surface of the through hole of said jar-like core is tapered to provide said first edge portion and said second edge portion.

4. A high frequency coil according to claim 1, wherein said bobbin has a top end which is disposed within said through hole of said jar-like core and said through hole of said metal case.

5. A high frequency coil according to claim 1, wherein the inner wall surface of said through hole of said jar-like core has a stepped shape to provide said first edge portion and said second edge portion.

6. A high frequency coil comprising: a threaded core, a bobbin, a coil-wound portion formed on an outside surface of said bobbin, said bobbin including an inside surface comprising a portion screwed with said threaded core, a jar-like core covering said bobbin and having a through hole for receiving a driver used to rotate said threaded core, and a metal case covering said jar-like core and having a through hole disposed at a location corresponding to said through hole of said jar-like core, said through hole of said jar-like core having an inner wall surface which includes (a) a first edge portion located radially inside of an edge of said through hole of said metal case and (b) a second edge portion located radially outside said edge of said through hole of said metal case.

* * * * *